US008668109B2

(12) United States Patent
Dickert

(10) Patent No.: US 8,668,109 B2
(45) Date of Patent: Mar. 11, 2014

(54) SLEEVE FOR BEVERAGE CUPS

(71) Applicant: James C. Dickert, Burr Ridge, IL (US)

(72) Inventor: James C. Dickert, Burr Ridge, IL (US)

( * ) Notice: Subject to any disclaimer, the term of this patent is extended or adjusted under 35 U.S.C. 154(b) by 0 days.

(21) Appl. No.: 13/626,341

(22) Filed: Sep. 25, 2012

(65) Prior Publication Data

US 2013/0200090 A1 Aug. 8, 2013

Related U.S. Application Data

(60) Provisional application No. 61/595,337, filed on Feb. 6, 2012.

(51) Int. Cl.
*B65D 25/00* (2006.01)

(52) U.S. Cl.
USPC ..... 220/739; 220/737; 220/738; 220/903

(58) Field of Classification Search
USPC ..... 220/737, 738, 739, 903; 215/386
See application file for complete search history.

(56) References Cited

U.S. PATENT DOCUMENTS

| | | | | |
|---|---|---|---|---|
| 3,908,523 | A | 9/1975 | Shikaya | |
| 5,205,473 | A | 4/1993 | Coffin, Sr. | |
| 5,222,656 | A | 6/1993 | Carlson | |
| 5,425,497 | A | 6/1995 | Sorensen | |
| 5,454,484 | A | 10/1995 | Chelossi | |
| 5,667,135 | A * | 9/1997 | Schaefer | 229/403 |
| 5,826,786 | A | 10/1998 | Dickert | |
| 5,842,633 | A | 12/1998 | Nurse | |
| 6,986,438 | B2 * | 1/2006 | Leung | 220/739 |
| 7,111,753 | B2 * | 9/2006 | Scheetz et al. | 215/12.1 |
| 2010/0200647 | A1 * | 8/2010 | Tedford et al. | 229/403 |

* cited by examiner

*Primary Examiner* — Anthony Stashick
*Assistant Examiner* — Madison L Poos
(74) *Attorney, Agent, or Firm* — Evelyn M. Sommer

(57) ABSTRACT

An insulating sleeve comprising a flat, elongated blank with straight top and bottom edges and end edges which are joined together at a glue flap. The sleeve includes a plurality of circumferentially spaced apart rows of generally longitudinally orientated and off-set slits. The rows of slits (5 to 10) are generally placed adjacent the glue flap and cover only a portion of the sleeve. Preferably at least one of the even or odd numbered slits extend to the top or bottom edge of the sleeve. In use, the sleeve is placed over the frustoconically shaped side wall of the cup which causes the sleeve to expand circumferentially until the desired fit is obtained.

16 Claims, 3 Drawing Sheets

SLEEVE FOR BEVERAGE CUPS

CROSS-REFERENCE TO RELATED APPLICATION

This application claims the benefit of provisional application Ser. No. 61/595,337, filed on Feb. 6, 2012, and is related to commonly owned U.S. Pat. No. 5,826,786 issued Oct. 27, 1998, the entire content of which is expressly incorporated herein by reference.

FIELD OF THE INVENTION

The instant invention relates generally to a sleeve adapted to be fitted on the outside of beverage cups, particularly beverage cups for holding relatively hot beverages in order to provide additional insulation for the hot contents of the cup.

BACKGROUND OF THE INVENTION

Hot and cold beverages and food (e.g., coffee, tea, soft drinks, soup, ice cream, and the like) may present a handling problem to consumers when dispensed into containers such as drinking cups. For example, paper, plastic, and foam drinking cups often do not provide sufficient thermal insulating properties when filled with hot or cold beverages. As a result, handling of such containers may be uncomfortable to the consumer.

Disposable cups are routinely used in fast food and roadside restaurants to contain both hot and cold drinks. Because such cups have relatively thin walls, insulation is poor. As a result, the cups in which hot beverages are served are often too hot to hold comfortably, and the outside surface of cups in which cold beverages are served often accumulate moisture, also making the cups difficult to hold, thus causing the holder's hand and the table to become wet. In addition, cold drinks warm quickly and hot drinks lose heat rapidly.

In response to the need for a better beverage insulator, various types of disposable cardboard and paper sleeves have been used. The sleeves are sized to slide onto the outside of a beverage cup and are held in place by friction and sometimes a thermoplastic coating as in U.S. Pat. Nos. 5,826,786 and 5,205,473. The wide diameter end of the typical beverage cup prevents the sleeve from sliding off the cup while the cup is being held.

In an effort to provide adequate insulation for comfortable handling of a paper cup, the art has proposed many versions of an insulating sleeve for holding the cup. These sleeves are frequently made from a paperboard blank that is configured to closely embrace the paper cup and protect the user's fingers from high temperatures. These sleeves, being disposable like the cup itself, still represent a much smaller burden on the environment than does an extra cup frequently used for this purpose.

One such insulating sleeve, disclosed in U.S. Pat. No. 5,425,497 to Sorensen, is made from an arcuate blank or band with oppositely extending slots at the ends, for joining the ends together, the band being of a sheet material characterized by a plurality of discrete, spaced-apart, approximately hemispherically-shaped depressions covering substantially the entire surface of the band, thus creating a plurality of insulating air gaps between the band and a cup around which the band is placed. Another such sleeve, disclosed in U.S. Pat. No. 5,842,633 to Nurse, is an arcuate band of flexible corrugated material with curved side walls, oppositely extending slots adjacent the ends of the band and tabs lying alongside the slots, the tabs projecting only part-way across the width of the band, to facilitate the setting up of the sleeve.

These configurations suffer from several drawbacks. In order to be used for holding a cup, the flat arcuate band must be rolled into a circle and its notched ends must be interlocked to form a tapered sleeve for holding the cup. This type of cup holder sleeve has the disadvantage that it must be assembled on site by the food service worker or the customer, which can be inconvenient and take additional time during food service. In addition, the need to interlock the notched ends on-site risks possible breakage or improper assembly. Various other types of sleeves that also require on-site assembly of opposing ends, such as with a fastener, e.g., a pressure-sensitive strip, have similar disadvantages.

Still other configurations have been devised that require no on-site assembly other than changing the configuration of the sleeve from a folded, stored position to an open position. For example, in U.S. Pat. No. 5,454,484 to Chelossi, the insulating sleeve is made from a folded arcuate paper stock blank whose ends have been adhered or glued to each other. This folded sleeve, which expands to an oval or eye like shape by squeezing the folded sleeve at the folds, thereby providing an opening to receive the bottom end of a tapered beverage cup, has become the standard in the field.

Other alternatives have also been proposed, such as cup sleeves disclosed in U.S. Pat. No. 3,908,523 to Shikaya, U.S. Pat. No. 5,205,473 to Coffin, Sr. and U.S. Pat. No. 5,222,656 to Carlson. The Shikaya '523 and Coffin, Sr. '473 patents each suggest providing thermal insulating sleeves for beverage cups having generally longitudinally oriented corrugations. The Carlson '656 patent suggests forming a tubular insulating sleeve from a felt-like material.

Another insulating sleeve for drink cups has been proposed in U.S. Pat. No. 5,667,135, which is embodied in a "honeycombed" insulative sleeve for a beverage cup side wall. The sleeve includes a plurality of circumferentially spaced-apart rows of generally longitudinally oriented and off-set slits. The slits thereby allow the sleeve to expand circumferentially when positioned on a portion of the beverage cup side wall and, by virtue of such circumferential expansion, to thereby form an insulative honeycomb structure therearound.

In still another patent, U.S. Pat. No. 6,986,438 to Leung, a sleeve is disclosed having a plurality of slits cut at least partway across the sleeve from the top edge of the sleeve, each slit comprising an entry point at the top edge of the sleeve and a terminal point at least partway across the sleeve. The cut out region has a width greater than the width of the slit. The cut out region is provided within the sleeve body at the terminal point of each slit. The result is that, when the container is inserted into the sleeve, the slits allow said top edge of the sleeve to spread so that the sleeve at least partially conforms to the container.

In the case of all pre-assembled sleeves, the final sleeve size is fixed and permanent so that it will fit standard cups of a specific taper and, as a result, the sleeve's position on a cup is pre-determined by the sleeve size and the cup taper. Generally this has been market accepted as long as the cups are consistent as to size and taper. It has been proposed to use an adhesive or a heat-activated coating to attempt to maximize cup adherence, and thus minimize the tendency of the sleeves to separate from the cup. This has been proved to be only marginally effective, especially in sleeves made with corrugated material, in which case the adhesive, without any intervention, seeps out of the bottom of the corrugated flutes.

SUMMARY OF THE INVENTION

It is an objective of the invention to either enhance or replace the heretofore available sleeves by providing the sleeve with an expandable and flexible feature that will adjust to minor taper differences and create a tension that will enhance adherence of the sleeve to the cup. The feature also will allow adjustment of the sleeve to slight differences in cup taper.

The present invention provides a sleeve configured to slidably receive and secure a beverage cup so as to provide insulation for a beverage cup sidewall. The sleeve includes a plurality of circumferentially spaced apart rows of generally longitudinally oriented and off-set slits that are disposed over a portion of the side wall. More specifically, the sleeve is provided with a series of adjacent parallel rows of slits, the slits of one row being off-set from (misaligned with) the slits of adjacent rows. Alternate rows of the sleeve have the slits extending to and beyond the sleeve blank so that it can expand with tension. The sleeve, when inserted over the sidewall of the beverage cup, will advance upwardly, causing the sleeve to further circumferentially expand, facilitating the advancement of the sleeve upwardly and aiding in securing the sleeve to the sidewall and also allowing the consumer to handle the beverage cup without physically touching the sidewall. As such, a significant barrier to the heat transferred through the sidewall is provided.

The slits, as noted, are off-set from the slits of adjacent rows. Preferably, there will be 3-6 and most preferably 3-5 rows of slits that extend to the top and bottom edge of the sleeve blank (rows 1-3-5) with alternate rows (2-4-6) having slits positioned so that the slits are opposite the un-slit area of the adjacent row. Only a portion of the sleeve and preferably about one inch thereof will be provided with the cut slits, but it is possible, where required, that more rows of slits will be provided. The slits preferably will be provided on the back side of the assembled sleeve close to the edge of the glue flap. With this arrangement the slit area will not interfere with any graphic or advertising material to be provided. In addition, manufacturing and assembly of the sleeve will not be adversely affected.

BRIEF DESCRIPTION OF THE DRAWINGS

The above and other objects and advantages of the invention will be apparent upon consideration of the following detailed description, taken in conjunction with the accompanying drawings, in which the reference characters refer to like parts throughout and in which.

DETAILED DESCRIPTION OF THE INVENTION

Figure 1:
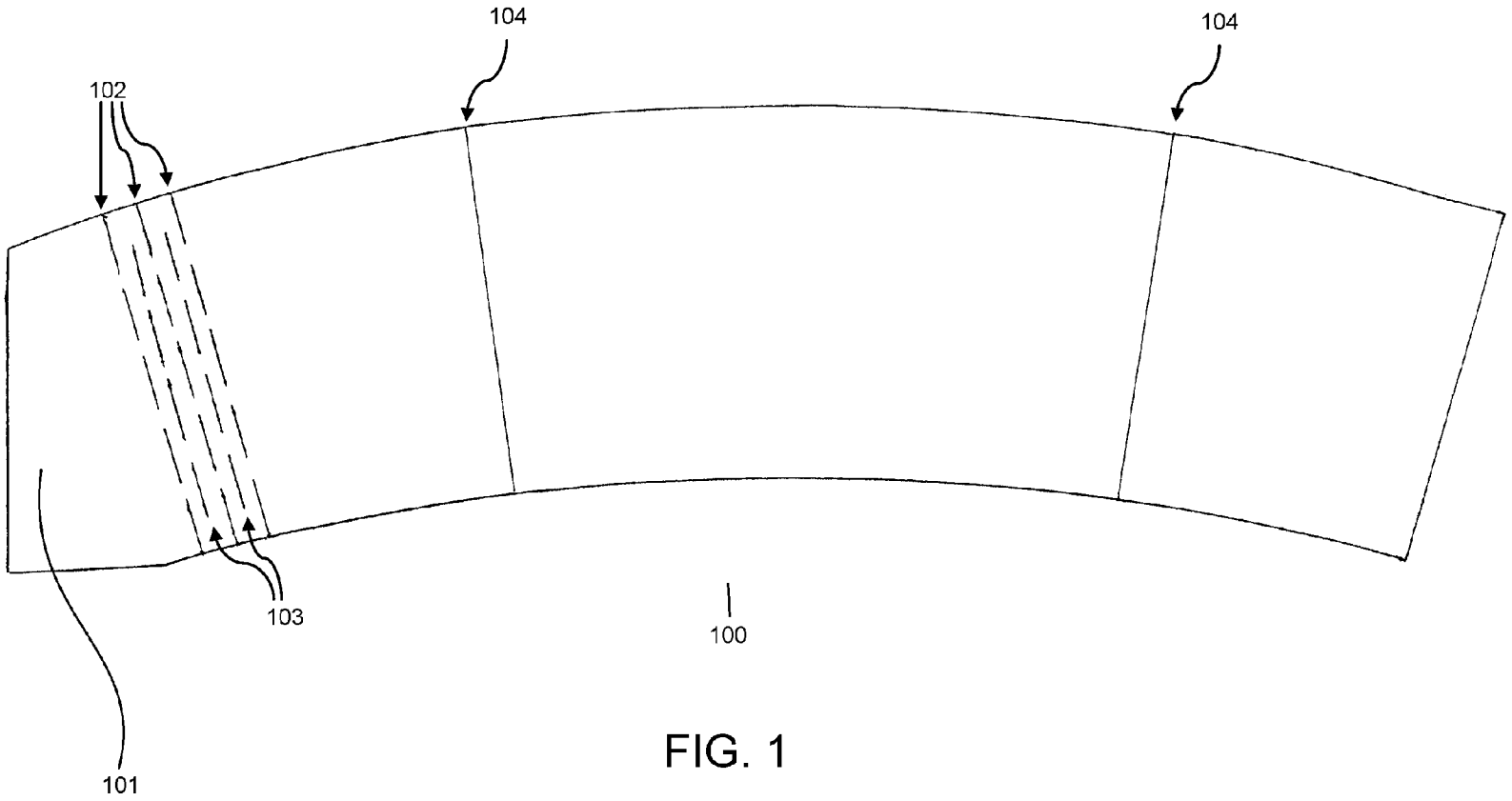
FIG. 1 illustrates a flat, unglued, sleeve blank.
Figure 2:
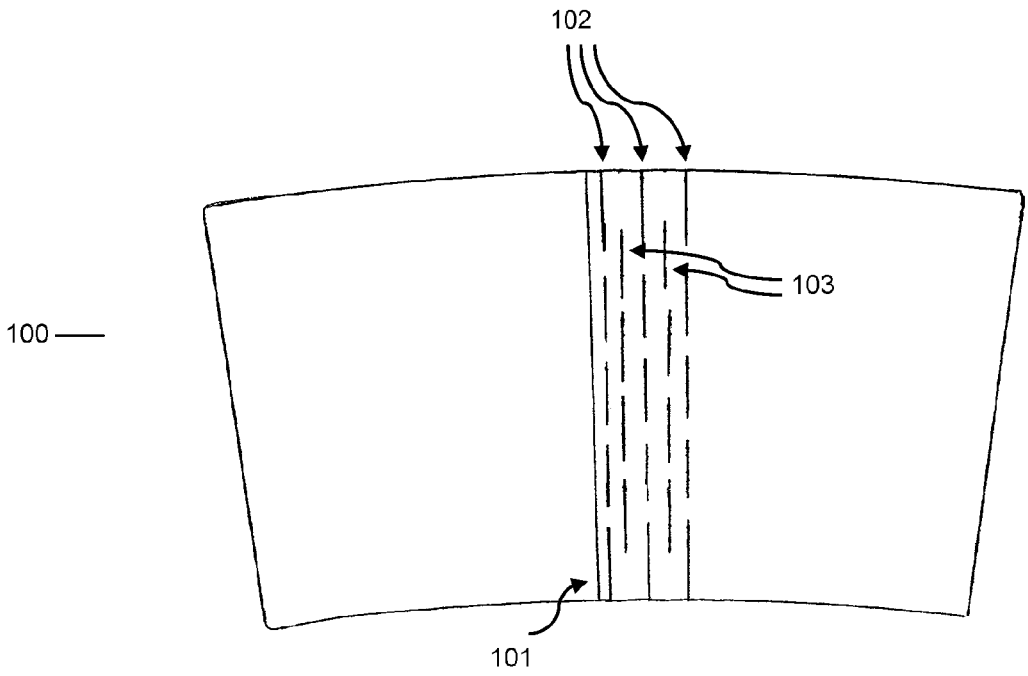
FIG. 2 illustrates a glued assembled sleeve before insertion of a cup.
Figure 3A:
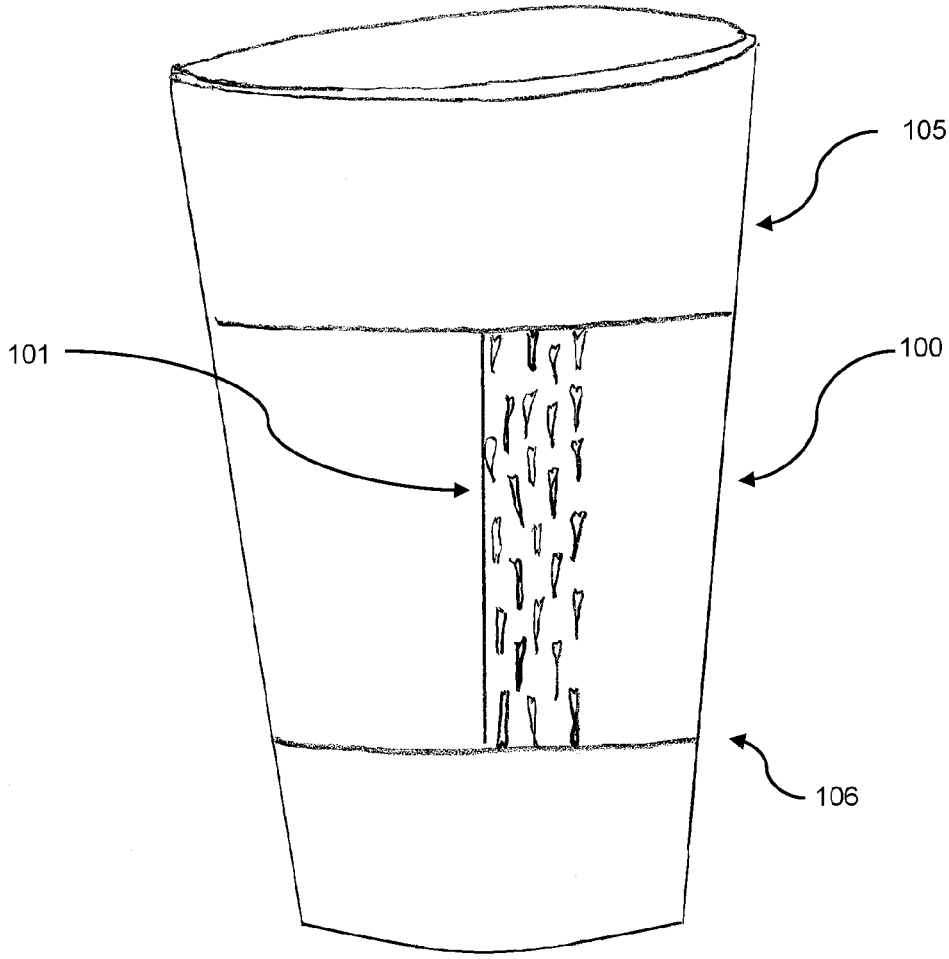
FIG. 3A illustrates a slightly extended sleeve with a cup inserted.
Figure 3B:
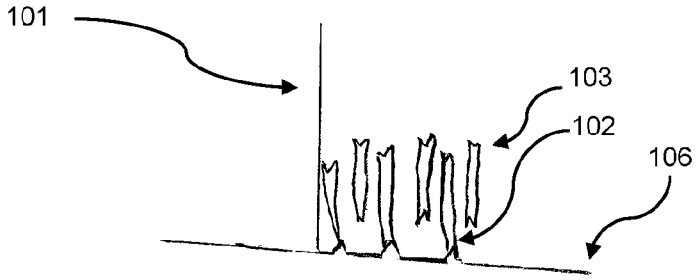
FIG. 3B illustrates the slits as formed (FIG. 3A) seen from the bottom edge of the sleeve.

The sleeve for a beverage cup as shown in FIG. 1 is formed from an elongated closed end band 100 made of paperboard material as is described in U.S. Pat. No. 5,826,786, the entire content of which is expressly incorporated herein by reference thereto. The blank or band is then formed into a flattened and folded shape as shown in FIG. 2 for storage and shipping and then formed into an annular shape and mounted about a cup as shown in FIG. 3*a*.

The blank is constituted of a paper material, preferably paperboard, which may or may not be embossed, corrugated board, preferably single-faced corrugated, or heavy weight paper, such as cardboard, so as to render the insulating sleeve rigid, for example to be able to support a cup filled with a beverage, and so that the insulating sleeve is reusable and recyclable. Single- or double-face corrugated paper having one or two liners adhered to one or both sides of a fluted sheet may also be used, so as to make the sleeve insulative, and the liner may be adhered to the fluted sheet by a variety of adhesives, such as biodegradable glue. In the case of the use of single-faced, corrugated board for making the sleeve, the liner would be slit and the expansion would take place as the liner spread and the corrugated allowed to stretch. The blank is approximately 200 mm to approximately 300 mm in width and approximately 50 mm to approximately 75 mm in height. In a preferred embodiment, the blank is approximately 232 mm in width and approximately 60-67 mm in height. In still another embodiment, the blank is approximately 200 mm to approximately 300 mm in width and approximately 60 mm in height. The insulating cup sleeve blank also has a plurality of transverse slits cut 103 therein as shown in FIG. 2. The slits serve to expand the surface of the insulating sleeve around the circumference of the cup being held. The slits comprise a plurality of off-set, spaced apart, generally longitudinally oriented slits. The slits allow the sleeve to expand circumferentially when positioned on a portion of the beverage cup side wall. The slits preferably comprise 6 rows, in which the slits of one row are off-set from (misaligned with) the slits of adjacent rows. The slits (odd numbered rows) extend in a direction perpendicular to the cut edge of the sleeve (top and bottom) across the height of the sleeve. The even numbered slits extend less than the height of the blank. The slits are provided at a distance from the glue lap edge 101 measured as shown in FIG. 1. The preferred embodiment has six slits, but there may be more slits, as for example, up to 10 depending upon the design of the blank or the size of the cup to be enclosed, such that a larger cup, and more specifically, a cup with a wider mouth, would require more slits in order to best accommodate the circumference thereof. As the cup 105 is forced deeper into the sleeve, the slits are forced farther apart horizontally (or circumferentially). The sleeve's slits alternatively terminate at the top 102 or bottom edges 106 of the sleeve, or both, and are effective for dispersing outwardly the tearing pressure that exists because of the circumferential spreading pressure of the cup as it is inserted into the sleeve.

The cup holder sleeve of the invention is preassembled as described in U.S. Pat. No. 5,826,786. The resulting cup holder sleeve is thus pre-assembled in a flat-folded form for compact storage and convenient handling. The cup holder sleeve is quickly and conveniently readied for use by squeezing on the outside surfaces of the flat-folded band around the first and second fold lines 104 so as to bow out the band into an annular sleeve with opened top and bottom ends. A cup having tapered sides is held in the cup holder sleeve by inserting the cup through its opened ends and press fitting therein.

More particularly, the cup holder sleeve in accordance with the present invention is formed from an elongated band made of paperboard material. The band has a top edge and a bottom edge, both in arcuate form concentric to and in parallel with each other. It also has first and second fold lines which are scored, slit cut, or perforated into the band material on an inside surface thereof. The longitudinally orientated slits are slit cut into the band material adjacent the side edge which will be the overlapping side edge. The fold lines 104 are spaced apart from each other at respective intermediate positions of the band and taper toward each other toward a concentric point (not shown). The opposite ends of the band are defined by first and second side edges.

The concentric top and bottom arcuate edges and tapered fold lines result in a truncated conical, tapered form. Instead of a smooth curve, the top and bottom edges may be cut with a decorative pattern for a more pleasing appearance. The shape of the top edge will mirror the bottom edge when successive units are formed by a single cut.

The cup holder sleeve is pre-assembled by folding the second side edge at fold line flat under and so as to be overlapped by the first side edge folded flat at fold line. The overlapping edges are adhered together with adhesive applied at mutually overlapping surfaces.

The resulting cup holder sleeve is thus pre-assembled in a flat-folded form for compact storage and convenient handling. The cup holder sleeve is quickly and conveniently readied for use by squeezing on the outside surfaces of the flat-folded band around the first and second fold lines so as to bow out the band into an annular sleeve with opened top and bottom ends. A cup having tapered sides is held in the cup holder sleeve by inserting the cup through its opened ends and press fitting it therein.

An alternative method of forming the pre-assembled flat-folded cup holder sleeve will now be described. The cup holder sleeve is die-cut from a blank sheet or web of stock material. The blank sheet or web may be embossed by a pair of calendar rolls prior to die-cutting the bands therefrom. Similarly, printing of the outside and/or inside surface(s) can be carried out at an upstream position before embossing or cutting. Alternatively, the stock material can be printed and embossed beforehand. The top, bottom and side edges of the elongated band are die-cut, the fold lines as well as the transverse slits and are scored, slit cut, or perforated at the same time. As each band is die-cut, the ends of the band can be folded and glued together in a subsequent tandem operation or in a separate gluing operation. The performance of these blank handling steps is well known in the paper products industry and is not described further herein. All of the steps of printing, embossing, die-cutting, scoring, folding and gluing can be done in one production process or in sequential or separate fabrication steps, as is well known in this field. The paperboard material can be selected kraft, news or white-lined recycled or virgin paperboard. Other types of materials, such as foamboard, or other laminate combinations may be used to make this product.

The pre-assembled (glued), flat-folded sleeve is easily opened by a squeezing motion which takes up hardly any time at the point of use. No hand assembly of interlocking parts or adhesive ends is required. Thus, the sleeve can even be handled by the ultimate user, thereby saving the vendor further time. The tapered dimensions of the sleeve can be selected to be able to accommodate two or more cup sizes with the same sleeve. Thus the number of sleeve types that have to be stocked can be few or even a single type. The cup holder sleeve in accordance with the invention can be fabricated easily in one production process or in separate or sequential steps, and at a low cost.

From the foregoing, it can be realized that this invention provides improved means for containing hot and cold liquids, which are safe and which can be produced inexpensively. The beverage containers and holders of this invention are readily fabricated with existing paper-making equipment, and do not present solutions to the waste disposal problem associated with polystyrene and the uncomfortable handling normally associated with wax-covered paper cups. Although various embodiments have been illustrated, this was for the purpose of describing, but not limiting, the invention. Various modifications, which will become apparent to one skilled in the art, are within the scope of this invention described in the attached claims.

The invention claimed is:

1. An insulating cup sleeve for encircling a frustoconical container having a sidewall end, a top end and a bottom end, said top end being wider than said bottom end, comprising:

a) an elongate body having elongated and substantially straight top and bottom edges and first and second end side edges, said body being substantially flat when said elongate body is in an unassembled configuration and said body being substantially cylindrical when said elongate body is in an assembled configuration with said first and second end edges being fastened to each other with glue, said body in an assembled configuration defining an annular sleeve with top and bottom openings for receiving said container therein; and further consisting of:

b) a plurality of circumferentially spaced apart, adjacent parallel rows of slits disposed over a minor portion of the sidewall, each of said slits having slit and unslit areas, the slits of one row being offset from the slits of adjacent rows, said plurality of slits being arranged spaced apart from each other and arranged at least part way across the height of said annular sleeve and adjacent and parallel to the glued edge of the sleeve, serving for expanding the sleeve around the cup's circumference; and c) wherein at least one of the parallel rows of the plurality of slits terminate at the top or bottom edges of the sleeve and are positioned about a circumferential portion of the sidewall of the frustoconically shaped container to allow the sleeve to expand circumferentially when positioned on a portion of the container side wall.

2. An insulating cup sleeve according to claim 1, wherein said plurality of slits comprises 5-10 rows of slits.

3. An insulating cup sleeve according to claim 1 wherein said plurality of slits comprises 3-5 rows of slits.

4. An insulating cup sleeve according to claim 1, wherein one of either the even or odd numbered rows of slits extend to the bottom edge of the sleeve.

5. An insulating cup sleeve according to claim 1 wherein the slits terminate at the top, bottom or both edges of the sleeve to allow the sleeve to circumferentially expand and disperse outwardly the tearing pressure that exists when the sleeve is positioned on a portion of the container side wall and because of the circumferential spreading pressure of the container as it is inserted into the sleeve.

6. An insulating cup sleeve according to claim 1 further comprising first and second fold lines that are scored or cut scored across said elongate body and spaced apart from each other at respective intermediate positions of said body.

7. An insulating cup sleeve according to claim 1 wherein each slit is cut in a direction generally perpendicular to said top and bottom edges.

8. An insulating cup sleeve according to claim 1 constructed of a member selected from the group of paper board, which may or may not be embossed, corrugated board, including single-faced corrugated board, and cardboard.

9. An insulating cup sleeve according to claim 1 wherein said elongate body is about 200 to about 300 mm in width and about 50 to 75 mm in height.

10. An insulating cup sleeve according to claim 1 wherein said elongate body is about 300 mm in width and about 50 mm in height.

11. An insulating cup sleeve according to claim 8 constructed of corrugated board.

12. An insulating cup sleeve according to claim 11 constructed of single-faced corrugated board.

13. An insulating cup sleeve according to claim 8 constructed of embossed paperboard.

14. An insulating cup sleeve according to claim 1 wherein the slits in alternating rows are off-set from the slits of adjacent rows.

15. An insulating cup sleeve according to claim 1 wherein only about one inch of said sleeve is provided with parallel rows of slits.

16. An insulating cup sleeve according to claim 1 wherein the portion of the sleeve is provided with said parallel rows of slits so as not to interfere with any graphic or advertising material to appear on the sleeve.

* * * * *